US005342208A

United States Patent [19]

Kobayashi et al.

[11] Patent Number: 5,342,208

[45] Date of Patent: Aug. 30, 1994

[54] PACKAGE CONNECTOR APPARATUS

[75] Inventors: Tetsuya Kobayashi; Kenjiro Katabuchi; Yumiko Suzuki, all of Tokyo, Japan

[73] Assignee: NEC Corporation, Japan

[21] Appl. No.: 17,860

[22] Filed: Feb. 16, 1993

[30] Foreign Application Priority Data

Feb. 19, 1992 [JP] Japan ..... 4-069684

[51] Int. Cl.[5] ..... H01R 23/70

[52] U.S. Cl. ..... 439/79; 439/629

[58] Field of Search ..... 439/79, 80, 83, 629, 439/630, 62, 81, 82

[56] References Cited

U.S. PATENT DOCUMENTS

| | | | |
|---|---|---|---|
| 4,505,035 | 3/1985 | Burton et al. | 439/79 |
| 4,676,565 | 6/1987 | Reichardt | 439/79 |
| 4,820,173 | 4/1989 | Thom et al. | 439/79 |
| 4,871,321 | 10/1989 | Johnson | 439/79 |
| 4,992,052 | 2/1991 | Verhoeven | 439/79 |
| 5,201,662 | 4/1993 | Roche | 439/79 |

*Primary Examiner*—Larry I. Schwartz

*Assistant Examiner*—Hien D. Vu

*Attorney, Agent, or Firm*—Laff, Whitesel, Conte & Saret

[57] ABSTRACT

A package connector apparatus of the SMT type which eliminates a discontinuous point in characteristic impedance to assure a good high frequency transfer characteristic and is compatible with another package connector apparatus of the through-hole dip type. A printed circuit board has a plurality of wiring patterns formed on each of the opposite first and second faces thereof, and a connector body is mounted on the first face of the printed circuit board with the center thereof displaced to the first face side of the printed circuit board and has first and second faces formed thereon. A plurality of contacts are mounted in a plurality of rows on and extend from the first and second faces of the connector body. The contacts extending from the first face are connected at the other end portions thereof to the wiring patterns on the first face of the printed circuit board while the other contacts extending from the second face of the connector body are connected at the other end portions thereof to the wiring patterns on the second face of the printed circuit board.

1 Claim, 4 Drawing Sheets

PACKAGE CONNECTOR APPARATUS

BACKGROUND OF THE INVENTION

1. Field of the Invention

This invention relates to a package connector apparatus, and more particularly to a connector apparatus for electrically connecting a package including an electric circuit mounted on a printed circuit board to an external circuit.

2. Description of the Related Art

Conventional package connector apparatus are popularly formed as package connector apparatus of the through-hole dip type. Exemplary construction one of such conventional package connector apparatus is shown in FIG. 6. Referring to FIG. 6, a connector body 1 is secured to the front surface, that is, an upper face, at an end portion of a printed circuit board 2. A plurality of contacts or pins 4 are provided in for example, four, horizontal rows and extend horizontally from a vertical side face 3 of the connector body 1. The contacts 4 are individually bent into an L-shape such that they extend downwardly from intermediate portions thereof. The L-shapes of the contacts 4 are different from each other that, in each vertical column, each contact 4 has a smaller L-shape than an adjacent contact 4 above it and is included in the L-shape of the adjacent contact 4. The other end portions of the contacts 4, which extend downwardly, extend through corresponding through-holes 5 perforated in the printed circuit board 2 and downwardly below the rear surface, that is, a lower face, of the printed circuit board 2. Each of the contacts 4 is soldered, at a portion thereof in the corresponding through-hole 5, to a wiring pattern (not shown) on the printed circuit board 2. A circuit part 6 is mounted on the printed circuit board 2. Another connector 8 is mounted on another printed circuit board 7 of another package to which the package including the connector body 1 is to be connected.

The package connector apparatus of the throughhole dip type of FIG. 6 has a problem. In particular, since electromagnetic waves are radiated from each contact 4 when the frequency of a signal passing the contact 4 is high, the characteristic impedance of the contact 4 varies at a portion thereof which extends downwardly from the lower face of the printed circuit board 2 to cause a discontinuous point of the characteristic impedance, which deteriorates the signal transfer characteristic of the contact 4.

The problem can be solved if the package connector apparatus is constructed as a package connector apparatus of the SMT (Surface Mount Technology) type which eliminates through-holes. Thus, it seems a possible solution to employ such a structure as shown In FIG. 7. Referring to FIG. 7, a plurality of contacts 4 are provided in a plurality-of horizontal rows in upper and lower areas of a vertical side face of a connector body 1, and the contacts 4 in the upper area of the connector body 1 extend along an upper face 3 of a printed circuit board 2 and are connected, at the other ends thereof, to wiring patterns (not shown) 0n the upper face of the printed circuit board 2 while the contacts 4 In the lower area of the connector body 1 extend along a lower face of the printed circuit board 2 and are connected, at the other ends thereof, to wiring patterns (not shown) on the lower face of the printed circuit board 2. The connector body is supported so that an intermediate portion between the upper and lower areas thereof, that is, the center thereof in the vertical direction, is opposed to and not displaced from the printed circuit board 2.

With the package connector apparatus of the SMT type, since the connector body 1 is supported such that the center thereof in the vertical direction is opposed to the printed circuit board 2, the connector body 1 extends both upwardly and downwardly equally above and below the upper and lower faces of the printed circuit board 1, respectively. Consequently, the position of the connector body 1 with respect to the printed circuit 2 is different from that of the connector body 1 of the package connector apparatus of the through-hole dip type shown In FIG. 6. Consequently, SMT type package connector has no compatibility with the through-hole dip type which are used very popularly. The package connector apparatus of the two types cannot be employed commonly in the same appliance, which is inconvenient. Further, since the connector body 1 extends both upwardly and downwardly by a length equal to substantially one half the height thereof above and below the upper and lower faces of the printed circuit board 2, when a plurality or package are to be arranged in an overlapping relationship parallel to each other, where all of the packages are of the SMT type or some of the packages are of the SMT type and the remaining packages are of the through-hole dip type, in order to prevent each adjacent packages from interfering with each other, a greater distance is required between adjacent packages than that which is required between adjacent packages when all of the packages are of the through-hole dip type. In order to restrict the distance to a conventional level, circuit parts to be mounted on the printed circuit board 2 must be reduced in size as much.

SUMMARY OF THE INVENTION

It is an object of the present invention to provide a package connector apparatus of the SMT type which eliminates a discontinuous point in characteristic impedance to assure a good high frequency transfer characteristic.

It is another object of the present invention to provide a package connector apparatus of the SMT type which is compatible in positional relationship to a printed circuit board with another package connector apparatus of the through-hole dip type.

In order to attain the objects described above, according to the present invention, there is provided a package connector apparatus, which comprises a printed circuit board having a plurality of wiring patterns formed on each of the opposite first and second faces thereof, a connector body mounted on the first face of the printed circuit board with the center thereof displaced to the first face side of the printed circuit board, the connector body having first and second faces formed thereon, and a plurality of contacts mounted in a plurality of rows on the connector body and extending from the first and second faces of the connector body, the contacts which extend from the first face of the connector body being connected at the other end portions thereof to the wiring patterns on the first face of the printed circuit board while the other contacts which extend from the second face of the connector body are connected at the other end portions thereof to the wiring patterns on the second face of the printed circuit board.

Thus, the package connector apparatus is constructed as a package connector apparatus of the SMT type wherein none of the contacts extend through the printed circuit board to the opposite face side of the printed circuit board. Further, the connector body is supported in a displaced relationship to one face side of the printed circuit board with respect to the printed circuit similarly to that of a package connector apparatus of the through-hole dip type. Accordingly, the package connector apparatus has compatibility in installation into an equipment with a package connector apparatus of the through-hole dip type and can be used in a similar manner as such package connector apparatus of the through-hole dip type. Further, since the contacts connected to the wiring patterns on the respective faces of the printed circuit board do not extend outwardly farther than the other faces of the printed circuit board, a discontinuous point of the characteristic impedance of each contact when a high frequency signal passes the contact, which is a drawback of conventional package connector apparatus of the through-hole dip type as described above, can be eliminated. Accordingly, the package connector apparatus can be improved in high frequency transfer characteristic while maintaining the compatibility with a package connector apparatus of the through-hole dip type.

Preferably, the contacts which extend from one or each of the first and second faces of the connector body are arranged in first and second rows and have the other end portions arranged at equal distances alternately along a straight line on a corresponding one of the first and second faces of the printed circuit board. Alternatively, the contacts may have the other end portions arranged at equal distances alternately along two respective parallel straight lines on a corresponding one of the faces of the printed circuit board. With the package connector apparatus, a good high frequency transfer characteristic is maintained also where the number of contacts is increased.

Preferably, the connector body has an elongated recess formed thereon such that the first and second faces thereof are offset from each other in a direction alone the plane of the printed circuit board, and the contacts which belong to the first face extend from the first face to the first face of the printed circuit board while the contacts which belong to the second face extend from the second face through the recess to the second face of the printed circuit board. Consequently, the connector can be formed with a reduced size.

The above and other objects, features and advantages of the present invention will become apparent from the following description and the appended claims, taken in conjunction with the accompanying drawings in which like parts or elements are denoted by like reference characters.

DETAILED DESCRIPTION OF THE PREFERRED EMBODIMENT

Figure 1:
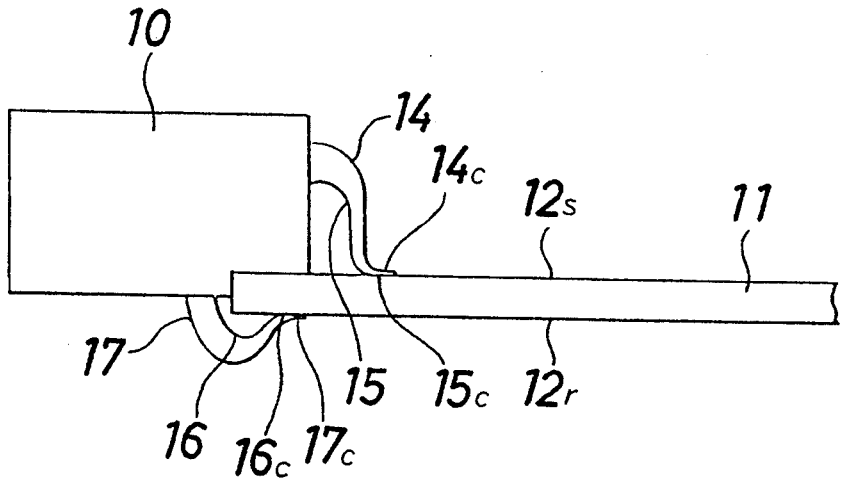
FIG. 1 is a front elevational view of a package connector apparatus showing a preferred embodiment of the present invention.
Figure 6:
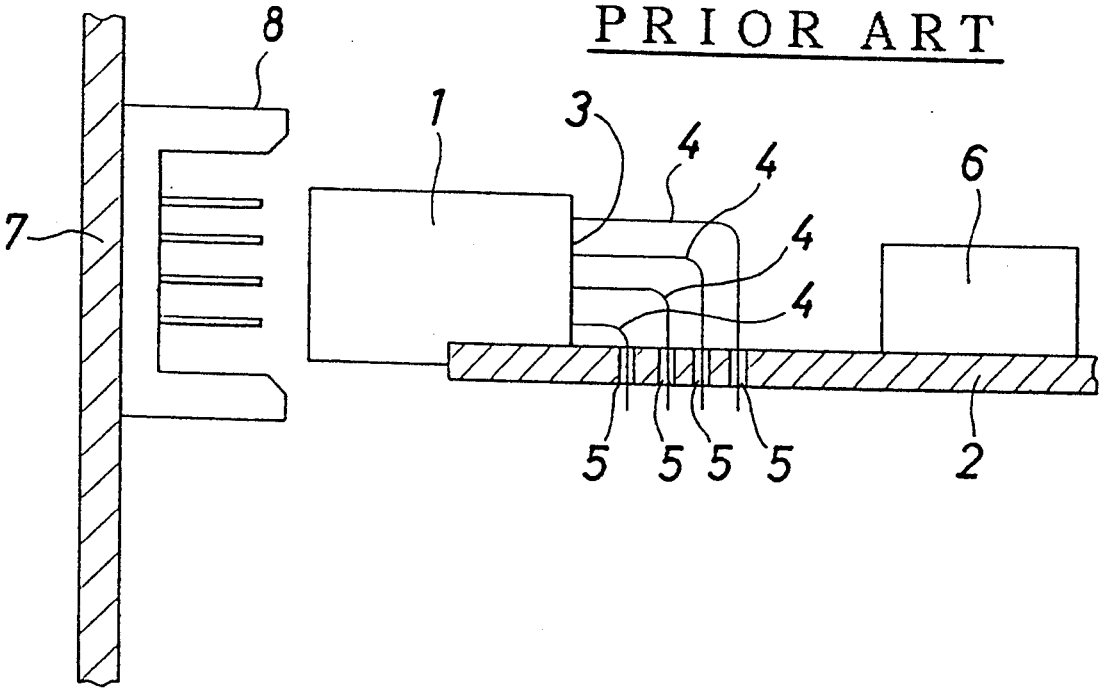
FIG.6 PRIOR ART
FIG. 6 is a schematic sectional view showing a conventional package connector apparatus of the through-hole dip type.
Figure 7:
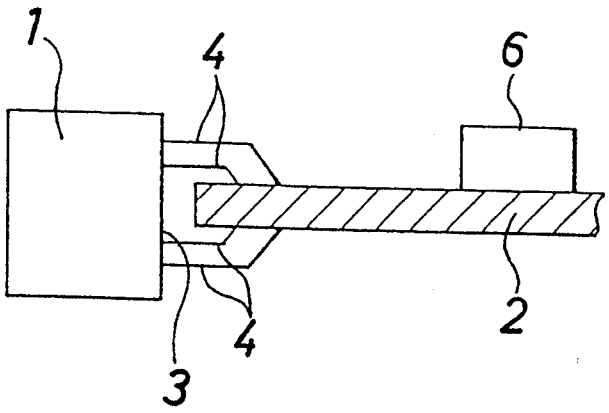
FIG. 7 is a schematic side elevational sectional view of a possible package connector apparatus of the SMT type.

Referring first to FIG. 1, there is shown a package connector apparatus to which the present invention is applied. A connector body 10 is placed, only at a rear end portion thereof, on an end edge portion of the front surface, that is, an upper face 12*s* of a printed circuit board 11 and secured to the printed circuit board 11 by means of a plurality of fixing members 13 such as screws or rivets. The connector body 10 is thus supported at a position displaced to the upper face side of the printed circuit board 11 similarly to that of the conventional package connector apparatus of the through-hole dip type shown in FIG. 6.

Figure 3:
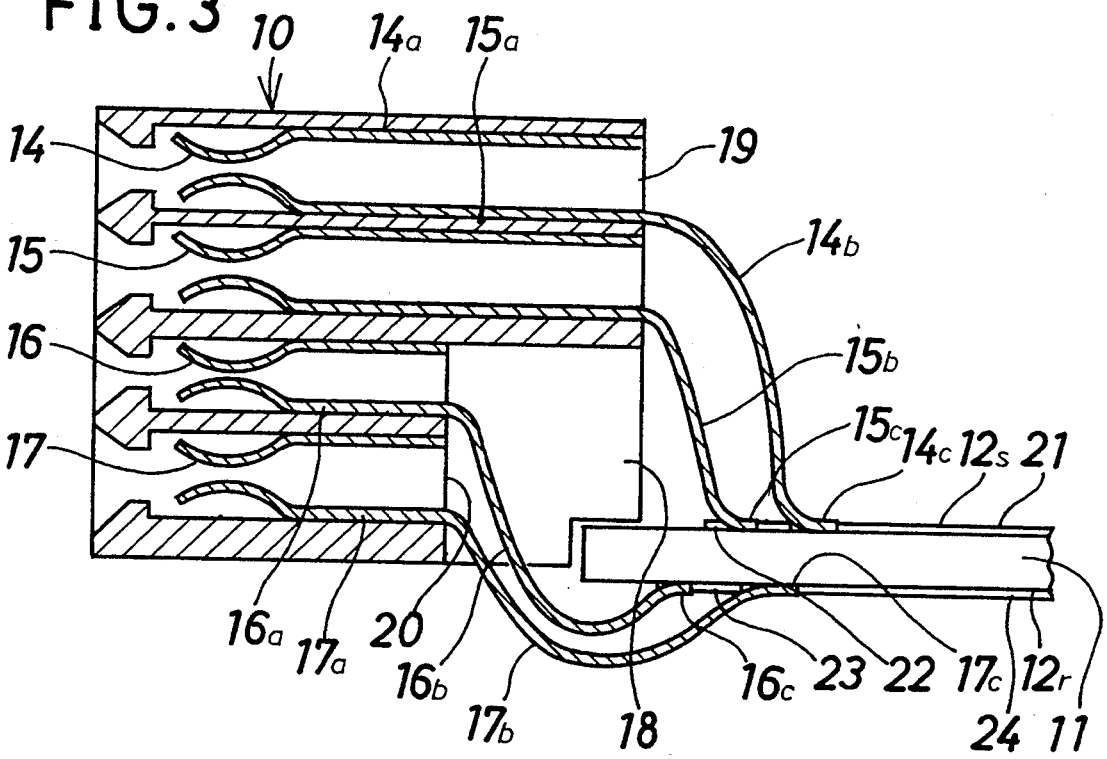
FIG. 3 is an enlarged vertical sectional view of the package connector apparatus of FIG. 1.
Figure 4:
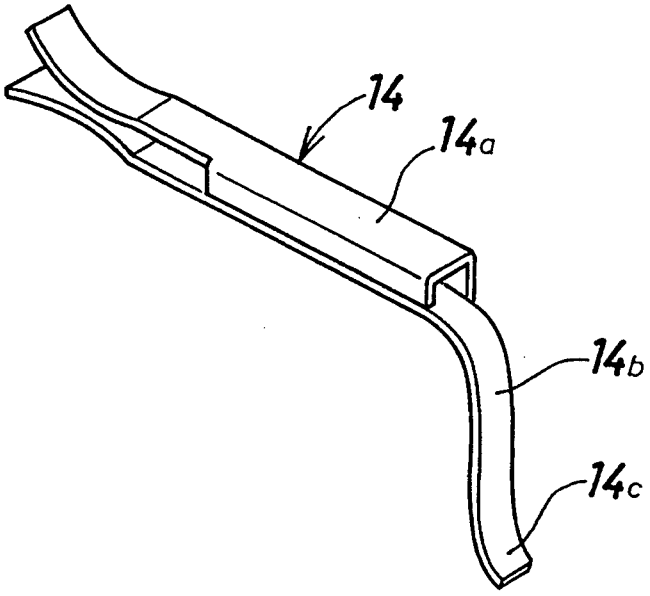
FIG. 4 is a perspective view of a contact used in the package connector apparatus of FIG. 1.

The connector body 10 has such a sectional configuration as shown in FIG. 3. Referring particularly to FIG. 3, a plurality of contacts 14,15, 16 and 17 are disposed in four horizontal rows from above such that the contacts 14 and 15 are disposed in two horizontal rows In the upper half of the inside of the connector body 10 while the contacts 16 and 17 are disposed on two horizontal rows In the lower half of the inside of the connector body 10. The contacts 14, 15, 16 and 17 are made of a conductive metal such as a copper alloy. One of the contacts 14 in the uppermost horizontal row is shown in detail in FIG. 4. Referring to FIG. 4, the contact 14 shown has a casing portion 14*a* for receiving therein another contact (not shown) provided on a connector (not shown) to which the package connector apparatus is to be connected, and a tongue portion 14*b* integrally formed on and extending from a rear end of the casing portion 14*a*. Referring back to FIG. 3, each of the contacts 15, 16 and 17 in the other horizontal rows similarly has a casing portion 15*a*, 16*a* or 17*a* and a tongue portion 15*b*, 16*b* or 17*b* formed on and extending from a rear end of the casing portion 15*a*, 16*a* or 17*a*.

An elongated recess 18 is formed at the lower half of a rear portion of the connector body 10 such that a rear face upper half 19 remaining above the recess 18 and a rear face lower half 20 defining an inner side face of the recess 18 are offset from each other in the forward and rearward direction, that is, in the leftward and rightward direction in FIG. 3. The tongue portions 14*b* and 15*b* of the contacts 14 and 15 in the upper two horizontal rows extend first horizontally from the rear face upper half 19 of the connector body 10 and then gradually downwardly to the upper face 12*s* of the printed circuit board 11, and the end portions 14*c* and 15*c* of the tongue portions 14*b* and 15*b* are connected to wiring patterns 21 and 22, respectively, on the upper face 12*s* of the printed circuit. The tongue portions 16*b* and 17*b* of the contacts 16 and 17 in the lower two horizontal rows extend gradually downwardly from the rear face lower half 20 to below in the recess 18 and then gradually upwardly, in a U-shaped profile, outside the recess 18 to the lower face 12*r* of the printed circuit board 11. The end portions 16*c* and 17*c* of the tongue portions 16*b* and 17*b* are connected to wiring patterns 23 and 24, respectively, on the lower face 12*r* of the printed circuit board 11. In this instance, the end portions 14*c* and 15*c* of the tongue portions 14*b* and 15*b* (FIG. 2) intersect each other without contacting each other and are arranged on printed circuit board upper face 12*s* such that portions thereof, are regularly at equal distances on a straight line. The end portions 16*c* and 17*c* of the tongue portions 16*b* and 17*b* are disposed in a similar manner on the rear face 12*r* of the printed circuit board 11.

In this manner, the transfer characteristic of a high frequency signal is not deteriorated when it passes any of the contacts 14, 15, 16 and 17. That is because the package connector apparatus of the present embodiment is constructed as a package connector apparatus of the SMT type wherein the end portions 14*c* and 15*c* 15*b* which are extensions of contacts 14 and 15 in are connected directly to the wiring patterns 21 and 22, respectively, on the printed circuit board upper face 12*s* and the end portions 16*c* and 17*c* are connected directly to the wiring patterns 23 and 24, respectively, on the lower face 12*r* of the printed circuit board 11 without through-holes. Also the end portions 14*c*, 15*c*, 16*c* and 17*c* are disposed, at the connecting portions thereof, spaced at equal distances on straight lines on the upper and lower faces of the printed circuit board 11. Further, confirmation of the reliability of a connecting portion, which is generally difficult with a package connector apparatus of the SMT type, can be performed readily, and also automatic inspection based on the Image processing technique can be performed. Besides, since the connector body 10 is supported in a condition wherein it is displaced to one side (the front face side) of the printed circuit board 11 with respect to the printed circuit board 11, the package connector apparatus of the present embodiment has compatibility in use with a conventional package connector apparatus of the through-hole dip type, and besides, circuit parts, which are to be mounted on such conventional package connector apparatus of the through-hole dip type, can be mounted also on the printed circuit board 11 of the package connector apparatus of the present embodiment.

Figure 2:
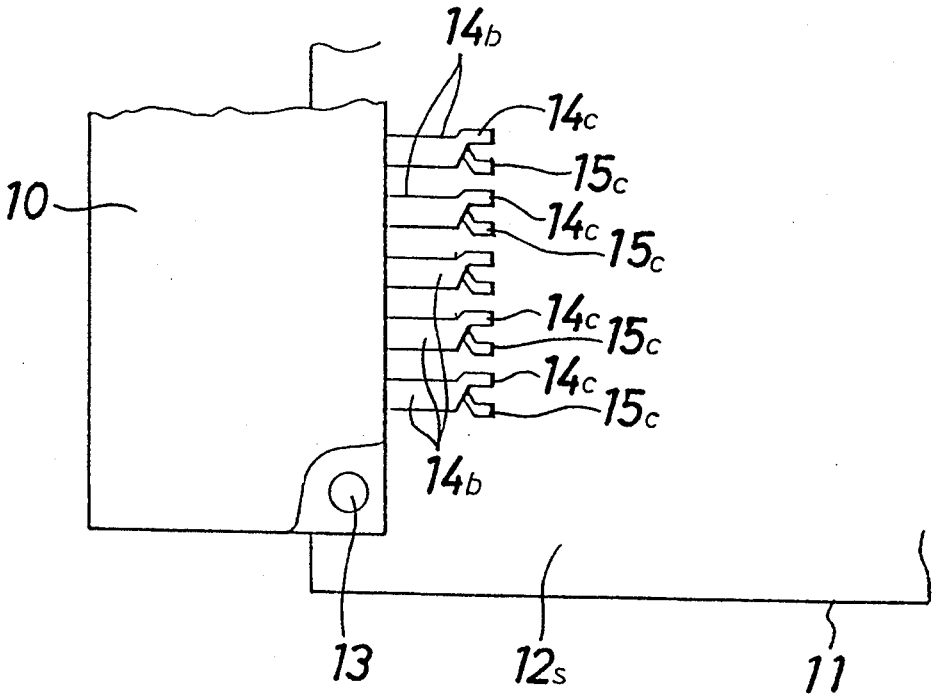
FIG. 2 is a plan view of the package connector apparatus of FIG.1.
Figure 5:
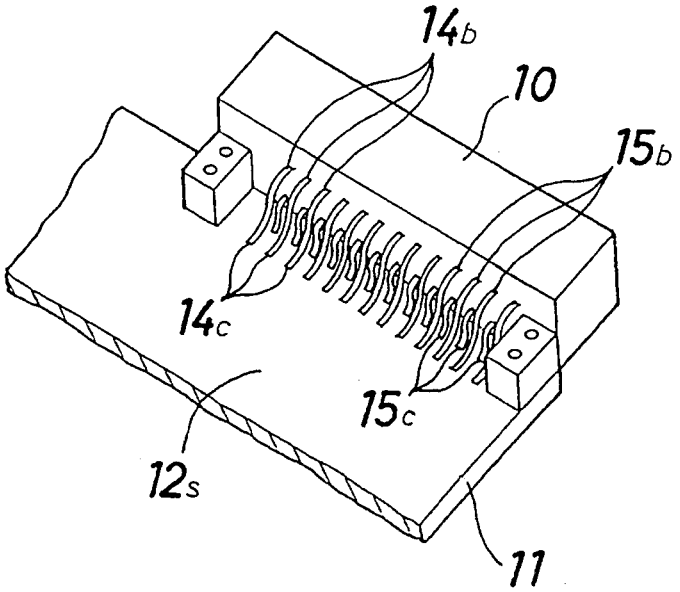
FIG. 5 is a perspective view of a modified package connector apparatus.

FIG. 5 shows a modification to the package connector apparatus shown in FIGS. 1 to 3. In the modified package connector apparatus, the end portions 14*c* and 15*c* of the tongue portions 14*b* and 15*b* of the contacts 14 and 15 in the upper two horizontal rows are positioned, at the connecting portions thereof, alternately in two respective forward and rearward parallel rows on the upper face of the printed circuit board 11, and though not shown, also the end portions of the tongue portions of the contacts In the lower two horizontal rows are positioned, at the connecting portions thereof, similarly alternately in two respective forward and rearward parallel rows on the lower face of the printed circuit board 11.

Having now fully described the invention, it will be apparent to one of ordinary skill in the art that many changes and modifications can be made thereto without departing from the spirit and scope of the invention as set forth herein.

What is claimed is:

1. A package connector apparatus, comprising:

a printed circuit board having a plurality of wiring patterns formed on each of the opposite first and second faces thereof;

a connector body securely mounted on said first face of said printed circuit board with a portion thereof received at an end portion of said first face of said printed circuit board such that a center of said connector body is displaced to the first face side of said printed circuit board and said connector body does not extend farther than said second face of said printed circuit board so that one of two surfaces thereof may be included in the range of thickness of said printed circuit board, said connector body having first and second faces formed thereon in such a manner as to extend perpendicularity to a plane of said connector body in an offset relationship from each other in a direction along the plane of said printed circuit board so as to define an elongated recess between them, said first face of said connector body being located farther than said second face of said connector body from the plane of said printed circuit board; and a plurality of contacts each having an elongated casing portion mounted on said connector body and protruding from said first and second faces of said connector body, those of said contacts which protrude from said first face of said connector body extending to said first of said printed circuit board so as to be connected to the wiring patterns on said first face of said printed circuit board while the other contacts protruding from said second face of said connector body extend in a flattened U-shaped configuration through and from said recess of said connector body to said second face of said printed circuit board so as to be connected to the wiring patterns on said second face of said printed circuit board.

* * * * *